United States Patent [19]

Igarashi

[11] Patent Number: 4,797,385

[45] Date of Patent: Jan. 10, 1989

[54] HEAT-SENSITIVE RECORDING MATERIAL

[75] Inventor: Akira Igarashi, Shizuoka, Japan

[73] Assignee: Fuji Photo Film Co., Ltd., Kanagawa, Japan

[21] Appl. No.: 7,206

[22] Filed: Jan. 27, 1987

[30] Foreign Application Priority Data

Jan. 24, 1986 [JP] Japan ..... 61-13397

[51] Int. Cl.[4] ..... B41M 5/18

[52] U.S. Cl. ..... 503/207; 427/150; 427/151; 428/326; 428/913; 503/225

[58] Field of Search ..... 427/150–152; 503/200, 207, 225; 428/326, 913

[56] References Cited

U.S. PATENT DOCUMENTS 4,484,204 11/1984 Yamamoto et al. ..... 503/200

FOREIGN PATENT DOCUMENTS 0188497 10/1984 Japan ..... 503/207
0145881 8/1985 Japan ..... 503/207
2028526A 3/1980 United Kingdom ..... 503/214

*Primary Examiner*—Bruce H. Hess
*Attorney, Agent, or Firm*—Sughrue, Mion, Zinn, Macpeak & Seas

[57] ABSTRACT

A heat-sensitive recording material having on a support a heat-sensitive recording layer which contains a colorless electron-donating dye precursor and an electron-accepting compound as main components, with heat-sensitive recording layer containing granules of starch or its derivative, which has a volume average granule diameter of from 5 to 30 microns, in a proportion of from 0.2 to 5 wt % based on the total weight of solids therein, thereby achieving enhancement of slippability at the recording layer surface without adversely affecting the density of printed characters.

10 Claims, No Drawings

HEAT-SENSITIVE RECORDING MATERIAL

FIELD OF THE INVENTION

The present invention relates to a heat-sensitive recording material, and, more particularly, to a heat-sensitive recording material which has improved slippability at the recording layer surface.

BACKGROUND OF THE INVENTION

Heat-sensitive recording materials of the kind which utilize electron-donating colorless dye precursors (hereinafter referred to as color formers) and electron-accepting compounds (hereinafter referred to as color developers) are disclosed, e.g., in Japanese Patent Publication Nos. 14039/70 (corresponding to U.S. Pat. No. 3,539,375) and 4160/68. Heat-sensitive recording materials (reference is also made herein to recording papers, as a typical heat-sensitive recording material) of these kinds have advantages in that they ensure noiseless recording due to non-impaction in recording action, and further, they do not require toner, ink ribbon, and other consumable materials except recording paper, so maintenance of such consumable materials becomes needless. Due to these advantages, such heat-sensitive recording materials have many uses, for example, facsimile equipment, printers, and so on.

These heat-sensitive recording materials have so far been required to have the properties of providing records with sufficient color density, having sufficient sensitivity to character-printing, having a high degree of whiteness in the background, and making formed color fast. Up to the present, they have continued to undergo improvements in these properties. In addition to the foregoing properties, good slippability has recently become a significant required of the recording layer.

This is because it has come to be improper with the speeding-up of recording to disregard the friction that occurs as a result between a heat-sensitive recording material and a thermal head of a heat-sensitive recording apparatus and the frictions caused by bringing a heatsensitive recording material into contact with other various parts of a recording apparatus.

Since a great force is needed for transport of the recording paper when the above-described frictions are great, it occurs upon printing operation that a paper-sending roll suffers from an insufficiency of torque, resulting in contraction of printed characters, or, what is worse, cessation of paper transport. These phenomena tend to occur pronouncedly under high temperature and high humidity conditions, and the readiness to cause these phenomena increases approximately in proportion to a co-efficient of statistical friction between a heat-sensitive recording layer and a thermal head surface (made of a vitrious material), and to those between the heat-sensitive recording layer and various parts of a recording apparatus (made of metals, resins, and so on). Accordingly, it has now become indispensable for high-speed recording to heighten the slippability of a heat-sensitive recording layer on a thermal head and so on.

SUMMARY OF THE INVENTION

Therefore, an object of the present invention is to provide a heat-sensitive recording material which has improved slippability at the recording layer surface, thereby facilitating high speed recording.

It has now been found that the above-described object is attained with a heat-sensitive recording material which comprises a support having provided thereon a heat-sensitive recording layer containing a color-former and a developer as main components, with said heat-sensitive recording layer containing granules of starch or a starch derivative, which have a volume average granule diameter (also referred to herein as the "average granule size") of from 5 to 30 μm, in a proportion of from 0.2 wt % to 5 wt % based on the total weight of solids therein.

DETAILED DESCRIPTION OF THE INVENTION

Starch and derivatives thereof which can be employed in the present invention include, e.g., corn starch, potato starch, sweet potato starch, tapioca, sago, wheat starch, rice starch, and derivatives thereof. Among these, corn starch and wheat starch are preferably used. It is necessary for them to have a volume average granule diameter ranging from 5 to 30 μm. If the volume average granule diameter is less than 5 μm, they cannot impart sufficient slippability to the recording layer surface, whereas if the volume average granule diameter is more than 30 μm, the granules spoil the flatness of the recording layer surface to result in insufficient density of the printed character. Of the foregoing starchy materials, corn starch is particularly preferred. As for the granule size, a volume average diameter ranging from 10 to 20 μm is particularly effective. Starch having a particular intended granule size may be obtained through a sieving process, etc.

It is thought that these effects are attributable to a sort of matting effect achieved by starch granules, whereby contact areas of a heat-sensitive recording layer with a thermal head, a frame, and so on are reduced. However, other particles, for example, particles of a synthetic high polymers such as polymethylmethacrylate, polystyrene, etc., or grains of inorganic substances such as heavy calcium carbonate, diatomaceous earth, etc., cannot produce the same effects, even if they have sizes similar to those described above. The reason for this is not clear, though it would seem likely that various characteristics of the particles, e.g., shape, hardness, glass transition point, etc., participate in producing the effects of the present invention.

When the starch granules are used, the resulting heat-sensitive recording layer comes to have advantages in that not only is its slippability improved, which is the object of the present invention, but also it hardly suffers from undesirable effects, for example, lowering of density of the printed image, and so on, provided that the granules are used in the foregoing specified amounts. In particular, corn starch possesses a greater advantage in that it does not cause any drop in density of the printed character, and that brings about great enhancement of the slippability alone.

Further regarding the content of starch (including starch derivative) granules, the amount is generally from 0.2 to 5 wt %, preferably, from 0.5 to 2 wt %, based on the total weight of solids in the heat-sensitive recording layer.

Methods for preparing the heat-sensitive recording material of the present invention are described below.

A color former and a developer are dispersed separately in small particles measuring several microns in diameter using a ball mill, a sand mill, or the like, and then mixed together. The dispersion step is, in general, carried out in the presence of an aqueous solution of water-soluble high polymer such as polyvinyl alcohol, etc. In addition, sensitizer can be dispersed and added to the mixture of the above-described dispersions, if desired. The sensitizers may be added to either of the color former or the developer, or both of them, and dispersed simultaneously.

Starch or a starch derivative which can be employed in the present invention is added to the mixture of a dispersion of color former and that of developer, and various additives are futher added thereto, if needed.

Examples of color formers which can be used in the present invention include triarylmethane compounds, diphenylmethane compounds, xanthene compounds, thiazine compounds, spiropyrane compounds and so on. Specific examples of triarylmethane compounds include 3,3-bis(p-dimethylaminophenyl)-6-dimethylaminophthalide (or Crystal Violet lactone), 3,3-bis(p-dimethylaminophenyl)phthalide, 3-(p-dimethylaminophenyl)-3-(1,3-dimethylindole-3-yl)phthalide 3-(p-dimethylaminophenyl)-3-(2-methylindole-3-yl)phthalide, and the like. Specific examples of diphenylmethane compounds include 4,4'-bisdimethylaminobenzhydrine benzyl ether, N-halophenyl-leuco auramine, N-2,4,5-trichlorophenylleuco auramine, and the like. Specific examples of xanthene compounds include Rhodamine-B-anilinolactam, Rhodamine-(p-nitroanilino)lactam, Rhodamine-B-(p-chloroanilino)lactam, 2-dibenzylamino-6-diethylaminofluoran, 2-anilino-6-diethylaminofluoran, 2-anilino-3-methyl-6-diethylaminofluoran, 2-anilino-3-methyl-6-cyclohexylmethylaminofluoran, 2-o-chloroanilino-6-diethylaminofluoran, 2-m-chloroanilino-6-diethylaminofluoran, 2-(3,4-dichloroanilino)-6-diethylaminofluoran, 2-octylamino-6-diethylaminofluoran, 2-dihexylamino-6-diethylaminofluoran, 2-m-trifluoromethylanilino-6-diethylaminofluoran, 2-butylamino-3-chloro-6-diethylaminofluoran, 2-ethoxyethylamino-3-chloro-6-diethylaminofluoran, 2-p-chloroanilino-3-methyl-6-dibutylaminofluoran, 2-anilino-3-methyl-6-dioctylaminofluoran, 2-anilino-3-chloro-6-diethylaminofluoran, 2-diphenylamino-6-diethylaminofluoran, 2-anilino-3-methyl-6-diphenylaminofluoran, 2-phenyl-6-diethylaminofluoran, 2-anilino-3-methyl-6-N-ethyl-N-isoamylaminofluoran, 2-anilino-3-methyl-5-chloro-6-diethylaminofluroan 2-anilino-3-methyl-6-diethylamino-7-methylfluoran, 2-anilino-3-methoxy-6-dibutylaminofluoran, 2-o-chloroanilino-6-dibutylaminofluoran, 2-p-chloroanilino-3-ethoxy-6-N-ethyl-N-isoamylaminofluoran, 2-o-chloroanilino-6-p-butylanilinofluoran, 2-anilino-3-pentadecyl-6-diethylaminofluoran, 2-anilino-3-ethyl-6-dibutylaminofluoran, 2-anilino-3-ethyl-6-N-ethyl-N-isoamylaminofluoran, 2-anilino-3-methyl-6-N-ethyl-N-γ-methoxypropylaminofluoran, 2-anilino-3-chloro-6-N-ethyl-N-isoamylaminofluoran, and so on. Specific examples of thiazine compounds include benzoyl leuco Methylene Blue, p-nitrobenzyl leuco Methylene Blue, etc. Specific examples of spiropyran compounds include 3-methyl-spiro-dinaphthopyran, 3-ethyl-spiro-dinaphthopyran, 3,3'-dichloro-spiro-dinaphthopyran, 3-benzyl-spiro-dinaphthopyran, 3-methyl-naphtho-(3-methoxybenzo)-spiropyran, 3-propyl-spiro-dibenzopyran, etc. These color formers can be used alone or as a mixture of two or more thereof.

The coating amount of the color-former is generally 0.2 to 1.0 g/m$^2$, preferably 0.3 to 0.5 g/m$^2$.

Examples of developers which can be used, include phenol compounds, organic acids or metal salts thereof, oxybenzoates, and so on. Of such compounds, phenol compounds, especially bisphenol compounds, are particularly preferred in that they can achieve their effects even when used in small amounts.

Oxybenzoates are preferred in that they tend to impart high density to the printed character.

These compounds are disclosed, e.g., in Japanese Patent Publication No. 14039/70 (corresponding to U.S. Pat. No. 3,539,375), 29830/76, and so on. Specific examples thereof include 4-tert-butylphenol, 4-phenylphenol, 4-hydroxy-diphenoxide, α-naphthol, β-naphthol, methyl-4-hydroxybenzoate, 2,2'-dihydroxybiphenol, 2,2-bis(4-hydroxyphenyl)propane (bisphenol A), 4,4'-isopropylidenebis(2-methylphenol), 1,1-bis(3-chloro-4-hydroxyphenyl)cyclohexane, 1,1-bis(3-chloro-4-hydroxy)-2-ethylbutane, 4,4'-secondary-isobutylidenediphenol, 1,1-bis(4-hydroxyphenyl)cyclohexane, 1,4-bis(4'-hydroxycumyl)benzene, benzyl 4-hydroxybenzoate, m-chlorobenzyl 4-hydroxybenzoate, β-phenetyl 4-hydroxybenzoate, 4-hydroxy-2',4'-dimethylphenylsulfone, 1-t-butyl-4-p-hydroxyphenylsulfonyloxybenzene, 4-N-benzylsulfamoylphenol, β-phenoxyethyl, 2,4-dihydroxybenzoate, benzyl 2,4-dihydroxy-6-methylbenzoate, and so on.

The coating amount of the developer is generally 0.4 to 2.0 g/m$^2$, preferably 0.5 to 1.5 g/m$^2$.

Desirable sensitizers are organic compounds having a melting point ranging from 70° C. to 150° C. and having good compatibility with color formers and developers. Specifically, compounds represented by formulae (IX) to (XIV) are illustrated below.

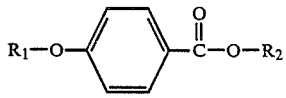

(IX)

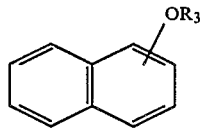

(X)

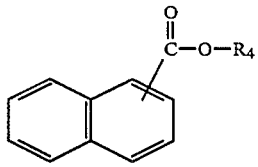

(XI)

$R_5NHCONH_2$ (XII)

$R_6CONH—R_7$ (XIII)

In formulae (IX) to (XIII), $R_1$ to $R_4$ each represents a phenyl group, a benzyl group, a phenyl group substituted with a lower alkyl group, a halogen atom or an alkoxy group, or a benzyl group substituted with a lower alkyl group, a halogen atom or an alkoxy group. $R_5$ and $R_6$ each represents an alkyl group containing from 12 to 24 carbon atoms, $R_7$ represents a hydrogen atom or a phenyl group.

When a phenyl group or a benzyl group represented by $R_1$ to $R_4$ in formulae (IX) to (XI) is substituted with a lower alkyl group, the lower alkyl group generally contains from 1 to 8, and preferably from 1 to 3, carbon atoms. When it is substituted with a halogen atom, the halogen is preferably chlorine or fluorine.

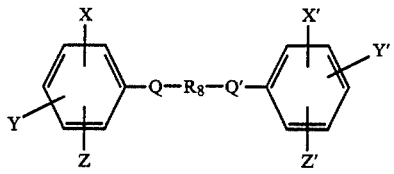

(XIV)

In formulae (XIV), $R_8$ represents a divalent group, preferably an alkylene group, an alkylene group having an ether bond, an alkylene group having a carbonyl group, an alkylene group having a halogen atom, or an alkylene group having an unsaturated bond, more preferably an alkylene group or an alkylene group having an ether bond. X, Y, Z, X', Y' and Z' may be the same or different, and each represents a hydrogen atom, an alkyl group, a lower alkoxy group, a lower aralkyl group, a halogen atom, an alkyloxycarbonyl group, or an aralkyloxycarbonyl group. Q and Q' each represents an oxygen atom or a sulfur atom.

The compounds represented by formulae (IX) to (XIV) have preferably a melting point ranging from 70° C. to 150° C., more preferably from 80° C. to 130° C.

Specific examples of such compounds include benzyl p-benzyloxybenzoate, β-naphthyl benzyl ether, stearic acid amide, palmitic acid amide, N-phenylstearic acid amide, N-stearylurea, phenyl β-naphthoate, phenyl 1-hydroxy-2-naphthoate, β-naphthol(p-chlorobenzyl)ether, β-naphthol(p-methylbenzyl)ether, α-naphthyl benzyl ether, 1,4-butanediol p-methylphenyl ether, 1,4-propanediol p-methylphenyl ether, 1,4-butanediol p-isopropylphenyl ether, 1,4-butanediol p-t-octylphenyl ether, 2-phenoxy-1-(p-tolyloxy)ethane, 1-phenoxy-2-)4-ethylphenoxy)ethane, 1-phenoxy-2-(4-chlorophenoxy)ethane, 1,4-butanediol phenyl ether, 1,2-bis(4-methoxyphenylthio)ethane, and so on.

The above-described heat-meltable substances may be used alone or as a mixture of two or more thereof. In order to impart sufficient heat responsiveness to the recording layer, such a heat-meltable substance as described above is preferably used in a proportion of 10 to 200 wt %, particularly 20 to 150 wt %, to the developer used.

As one of additives, an oil absorbing agent like an inorganic pigment is previously dispersed in a binder in order to prevent the contamination of a recording head upon recording. As another additive, a fatty acid, a metal soap or the like is further added for the purpose of enhancing the facility in releasing a recording head. In general, therefore, pigments, waxes and other additives in addition to color former, developer and sensitizers, which participate directly in coloration, are coated on a support to constitute a heat-sensitive recording material.

Specific examples of pigments which can be chosen for the present invention include kaolin, calcined kaolin, talc, pyrophylite, diatomaceous earth, calcium carbonate, aluminium hydroxide, magnesium hydroxide, magnesium carbonate, titanium oxide, barium carbonate, urea-formaldehyde filler, cellulose filler, and so on. Specific examples of waxes which can be used include paraffin wax, carnauba wax, microcrystalline wax, polyethylene wax, and higher fatty acid esters.

Examples of metal soaps include polyvalent metal salts of higher fatty acids. More specifically, zinc stearate, aluminum stearate, calcium stearate, zinc oleate, and the like can be used.

Examples of water-soluble high polymers which can be used include polyvinyl alcohol, hydroxyethyl cellulose, hydroxypropyl cellulose, ethylene-maleic anhydride copolymers, styrene-maleic anhydride copolymers, isobutylene-maleic anhydride copolymers, polyacrylic acid, polyacrylic acid amides, starch derivatives, casein, gelatin, carboxymethyl cellulose, methyl cellulose, and so on.

For the purpose of imparting a water resisting property to these water-soluble high polymers, a water proofing agent (e.g., a gelling agent or a cross-linking agent) or an emulsion of a hydrophobic polymer, such as a styrene-butadiene rubber latex, an acryl resin emulsion or so on, can be added.

The thus prepared coating composition is generally coated on base paper, preferably neutralized paper.

Also, the heat sensitive recording layer of the present invention can be provided on the coated side of a base paper on which a pigment as described above is coated in advance.

The granules of starch or its derivative of the present invention can be added in any mixing step of those described above. The starch granules or the starch derivative granules previously suspended in water can be added, if desired.

A general coverage of the heat-sensitive recording layer is from 2 to 10 g/m$^2$, on a solids basis. The lower limit of the coverage depends upon the density attainable by heat coloration, while the upper limit is determined mainly by economic considerations.

The present invention is illustrated in detail by reference to the following examples. However, the present invention should not be construed as being limited to the following examples.

EXAMPLES 1 TO 9

5 g of 2-anilino-3-methyl-6-cyclohexylmethylaminofluoran (color former) was dispersed together with 25 g of a 5% aqueous solution of polyvinyl alcohol (PVA-105, produced by Kuraray Co., Ltd.) in a 100 ml ball mill over a one-day period to prepare a dispersion of the color former.

Separately, 10 g of bisphenol A (developer) and 10 g of β-naphthyl benzyl ether (sensitizer) were mixed, and dispersed together with 100 g of a 5% aqueous solution of polyvinyl alcohol in a 300 ml ball mill over a one-day period to prepare a mixed dispersion of the developer and the sensitizer.

In addition, 25 g of calcium carbonate (Brilliant 15, produced by Shiraishi Kogyo Co., Ltd.) was dispersed into 30 g of a 0.5% solution of sodium hexametaphosphate using a homogenizer to prepare a pigment dispersion.

The foregoing three dispersions were mixed, and thereto, 10 g of a 30% dispersion of zinc stearate (Handorin Z-7, produced by Chukyo Fat & Oil Co., Ltd.) was further added to prepare a basic coating composition A.

To the basic coating composition A were added starch granules whose kind, size and amount used are set forth in Table 1. Specifically, starch granules previously made into a 20 wt % suspension was used upon addition. The resulting coating composition was coated on wood free paper having a basis weight of 50 g/m$^2$ so as to have a coverage of 5 g/m$^2$ on a solids basis. After drying, the coat was subjected to a calendering finish under a linear pressure of 2 kg/cm of width to obtain a sample.

On each sample, solid printing was carried out using a character-printing tester, Type KRT, made by Kyocera under the conditions that an output was 0.7 W/dot, the pulse width was 0.8 ms, and the character-printing density was 8 dot/mm×7.7 dot/mm (35 mj/mm$^2$), and the solid density was measured with a Macbeth reflective densitometer Model 918 (through a #106 filter).

The higher solid density value signifys the higher character-printing sensitivity, and is one of desirable properties.

As for the slippability, statistical friction coefficients between the glass surface and the recording layer face were measured under the conditions of 20° C. and 60% RH (relative humidity) and 35° C. and 85% RH, respectively.

The results obtained are shown in Table 1.

COMPARATIVE EXAMPLES 1 TO 5

Samples were prepared according to the same formulation as described in Examples 1 to 9, except that starch granules having sizes outside of the range of the invention were added in amounts departing from the scope of the invention. The results obtained are shown in Table 2. The data therein indicate that the smaller amount of addition enhanced the slippability to the less extent, particularly under the conditions of high temperature and high humidity (35° C., 85% RH), while the larger amount of addition lowered drastically the density of printed characters.

COMPARATIVE EXAMPLES T TO 10

Samples were prepared in the same manner as Examples 1 to 9, except that conventional pigment or filler particles were added in place of the granules of starch or derivatives thereof. The results obtained are shown in Table 3. As can be seen from the data therein, the particles used brought about great decreases in density of printed characters and insufficient increase in slippability, compared with starch granules and derivatives thereof.

TABLE 1

| Sample | Kind of Starch | Average Granule Size | Amount Added | Density of Printed Character | Friction Coefficient 20° C., 65% RH | Friction Coefficient 35° C., 85% RH |
|---|---|---|---|---|---|---|
| 1 | corn | 16 μm | 0.2% | 1.21 | 0.40 | 0.45 |
| 2 | " | " | 0.5% | 1.21 | 0.38 | 0.40 |
| 3 | " | " | 2.0% | 1.20 | 0.37 | 0.37 |
| 4 | " | " | 5.0% | 1.17 | 0.36 | 0.37 |
| 5 | wheat | 12 μm | 1.0% | 1.20 | 0.40 | 0.48 |
| 6 | " | 25 μm | " | 1.18 | 0.40 | 0.43 |
| 7 | potato | 30 μm | " | 1.17 | 0.40 | 0.40 |
| 8 | sweet potato | 20 μm | " | 1.17 | 0.42 | 0.45 |
| 9 | oxidized starch | 8 μm | " | 1.20 | 0.42 | 0.47 |

TABLE 2

| Sample | Kind of Starch | Average Granule Size | Amount Added | Density of Printed Character | Friction Coefficient 20° C., 65% RH | Friction Coefficient 35° C., 85% RH |
|---|---|---|---|---|---|---|
| 1 | none (control) | — | — | 1.21 | 0.51 | 0.72 |
| 2 | corn | 16 μm | 0.1% | 1.21 | 0.43 | 0.57 |
| 3 | " | " | 8% | 1.12 | 0.38 | 0.38 |
| 4 | rice | 4 μm | 1% | 1.20 | 0.46 | 0.68 |
| 5 | potato | 40 μm | " | 1.06 | 0.37 | 0.37 |

TABLE 3

| Sample | Kind of Starch | Average Granule Size | Amount Added | Density of Printed Character | Friction Coefficient 20° C., 65% RH | Friction Coefficient 35° C., 85% RH |
|---|---|---|---|---|---|---|
| 6 | heavy calcium carbonate | 9 μm | 1% | 1.18 | 0.47 | 0.65 |
| 7 | heavy calcium carbonate | 28 μm | " | 1.01 | 0.42 | 0.56 |
| 8 | diatomaceous earth | 26 μm | " | 0.89 | 0.38 | 0.40 |
| 9 | polymethyl-methacrylate | 15 μm | " | 1.03 | 0.49 | 0.67 |
| 10 | polystyrene | 20 μm | " | 0.98 | 0.42 | 0.59 |

While the invention has been described in detail and with reference to specific embodiments thereof, it will be apparant to one skilled in the art that various changes and modifications can be made therein without departing from the spirit and scope thereof.

What is claimed is:

1. A heat-sensitive recording material comprising a support having provided thereon a heat-sensitive recording layer containing a colorless electron-donating dye precursor and an electron-accepting compound as main components, with said heat-sensitive recording layer containing granules of starch or a starch derivative, which have a volume average granule diameter of from 10 μm to 30 μm, in a proportion of from 0.2 wt % to 5 wt % based on the total weight of solids therein.

2. A heat-sensitive recording material as in claim 1, wherein said starch or starch derivative is selected from the group consisting of corn starch, potato starch, sweet potato starch, tapioca, sago, wheat starch, rice starch, and derivatives thereof.

3. A heat-sensitive recording material as in claim 2, wherein the volume average diameter of the granules of strach or starch derivative ranges from 10 to 20 μm.

4. A heat-sensitive recording material as in claim 2, wherein the content of starch granules is from 0.5 to 2 wt % based on the total weight of solids in the heat-sensitive recording layer.

5. A heat-sensitive recording material as in claim 1, wherein said starch or derivative is corn starch or wheat starch.

6. A heat-sensitive recording material as in claim 5, wherein the volume average diameter of the starch granules ranges from 10 to 20 μm.

7. A heat-sensitive recording material as in claim 6, wherein the content of corn starch granules or wheat starch granules is from 0.5 to 2 wt % based on the total weight of solids in the heat-sensitive recording layer.

8. A heat-sensitive recording material as in claim 5, wherein the content of corn starch granules is from 0.5 to 2 wt % based on the total weight of solids in the heatsensitive recording layer.

9. A heat-sensitive recording material as in claim 1, wherein the volume average diameter of the granules of starch or starch derivative ranges from 10 to 20 μm.

10. A heat-sensitive recording material as in claim 1, wherein the content of starch granules is from 0.5 to 2 wt % based on the total weight of solids in the heat-sensitive recording layer.

* * * * *